US005542814A

United States Patent [19]

Ashcroft et al.

[11] Patent Number: 5,542,814

[45] Date of Patent: Aug. 6, 1996

[54] METHOD OF LIFTING A SKID STEER LOADER BUCKET

[75] Inventors: Dale A. Ashcroft, New Holland; Robert R. Todd, Leola, both of Pa.

[73] Assignee: New Holland North America, Inc., New Holland, Pa.

[21] Appl. No.: 344,783

[22] Filed: Nov. 22, 1994

[51] Int. Cl.[6] ..... B66C 23/00

[52] U.S. Cl. ..... 414/786; 414/686; 414/685; 414/710; 414/917

[58] Field of Search ..... 414/685, 686, 414/917, 710, 680, 689, 786

[56] References Cited

U.S. PATENT DOCUMENTS

| | | | |
|---|---|---|---|
| 3,215,292 | 11/1965 | Halls . | |
| 3,903,978 | 9/1975 | Kraus | 180/6.48 |
| 3,963,131 | 6/1976 | Dimmer | 214/140 |
| 3,995,761 | 12/1976 | Hurlburt | 214/776 |
| 4,162,873 | 7/1979 | Smith, Jr. | 414/718 |
| 4,355,946 | 10/1982 | Wykhuis et al. | 414/707 |
| 4,825,568 | 5/1989 | Kawamura et al. | 414/686 |
| 4,844,685 | 7/1989 | Sagaser | 414/700 |
| 4,892,155 | 1/1990 | Wanamaker | 172/199 |
| 4,936,737 | 6/1990 | Rae et al. | 414/686 |
| 5,169,278 | 12/1992 | Hoechst et al. | 414/686 |
| 5,184,932 | 2/1993 | Misuda et al. | 414/685 |

FOREIGN PATENT DOCUMENTS

| | | | |
|---|---|---|---|
| 1244300 | 9/1960 | France | 414/685 |

*Primary Examiner*—David A. Bucci
*Assistant Examiner*—Gregory A. Morse
*Attorney, Agent, or Firm*—Frank A. Seemar; Larry W. Miller

[57] ABSTRACT

A skid steer loader having a frame, ground support wheels extending from the frame, a cab with load bearing side walls extending upwardly from the frame to define an operators control area therebetween, and a boom structure comprising a pair of arms and a linkage assembly for operatively coupling the arms to the load bearing side walls. Each arm includes a front portion having a front end extending beyond the cab to support a bucket, a rear portion extending behind the cab, and an integral intermediate portion between the front and rear portions. The linkage assembly includes upper and lower links associated with each of the arms, each link being pivotally secured to the cab at a location above the wheels. The boom structure is powered for raising and lowering in concert each of the pairs of arms through a generally vertical path for moving the front end of the boom arms and bucket along a lift path. The bucket initially moves from a known position near the ground in a substantially vertical direction to an intermediate position in the lift path, and subsequently in a slightly forwardly inclined direction to a second intermediate position, from which it finally moves in a substantially vertical direction to complete its lift path.

7 Claims, 3 Drawing Sheets

10
12
13
14
16
11
20
21
22
24
25
26
27
28
30
31
32
34
35
36
37
40
41
42
43
44
45
46
47

METHOD OF LIFTING A SKID STEER LOADER BUCKET

FIELD OF THE INVENTION

The present invention relates generally to front end loaders and more particularly to a skid steer loader having an improved method of moving a material handling means through a lift path.

BACKGROUND OF THE INVENTION

Over the years skid steer loaders have been known as agile, compact vehicles with a high degree of maneuverability and a wide range of applications in the agricultural, industrial and construction fields. These vehicles usually include an engine, a boom assembly and an operators compartment mounted on a frame supported by four ground supporting wheels. Coupled to the engine are a main drive system and a lift system for the boom assembly. The vehicle is maneuvered by driving the wheels on one side at a different speed and/or in a different direction from those on the other side resulting in a turning motion, the severity of which is determined by the relative speeds.

Typically the engine, which is rear mounted for counterbalancing effect, drives a pair of hydrostatic pumps coupled to left and right mounted hydrostatic motors. Wheels on the left and right sides of the vehicle are driven by the left and right mounted motors through gears, chains and sprockets. Motion is usually controlled by an operator seated within the operators compartment by actuating a pair of control levers which are linked to the pumps. The extent to which each lever is moved in a forward direction from a neutral position controls the amount of fluid supplied in a forward direction to its respective motor, and therefore the speed at which the wheels on that side of the vehicle will rotate. Similarly, the extent to which a lever is moved in the reverse direction from the neutral position will control the speed at which the associated wheels rotate in the reverse direction.

As mentioned above, skid steer loaders include a boom assembly. In one common arrangement the boom assembly comprises a pair of lift arms pivotally mounted directly to the main frame, or a support frame extending upwardly from the main frame as shown in U.S. Pat. No. 3,903,978, issued Sep. 9, 1975 in the name of Peter B. Kraus. Material handling attachments, such as the bucket 18 shown in this patent, are usually mounted on the front of the lift arms. U.S. Pat. No. 3,961,131, issued Jun. 15, 1976 in the name of Donald J. Dimmer, and U.S. Pat. No. 4,892,155, issued Jan. 9. 1990 in the name of Richard B. Wanamaker, also are representative of skid steer loader type vehicles having lift arms pivotally affixed to the main frame.

Another well known arrangement found in vehicles of this type comprises a pair of lift arms coupled to the frame by means of a linkage assembly, as best illustrated by U.S. Pat. No. 3,215,292, issued Nov. 11, 1965 in the name of Lawrence M. Halls. This linkage arrangement enhances the path of the bucket by moving it outwardly from vertical as it rises. Similar linkage systems on skid steer loaders type vehicles are disclosed in U.S. Pat. No. 3,995,761, issued Dec. 7, 1976 in the name of Joseph C. Hurlburt and U.S. Pat. No. 4,355,946, issued Oct. 26, 1982 in the name of Lloyd A. Wykhuis, et al.

A separate hydraulic system is usually used in skid steer loaders to power the boom assembly via hydraulic lift cylinders coupled to the lift arms. This same system can also be used to actuate one or two tilt cylinders which pivot the attachment relative to the lift arms, which is commonly referred to as dumping or curling the attachment. Typically, a pair of foot pedals in the front of the operator compartment control the flow of hydraulic fluid from a hydraulic pump to the lift and tilt cylinders.

In addition to material handling buckets, various other attachments such as snow blowers, trenchers, tree spades and augers which include their own hydraulic motors and/or cylinders are commonly mounted to the boom assembly. An auxiliary hydraulic system is used to control the flow of hydraulic fluid between the pump and the hydraulic motor of the front mounted attachment. It is common in prior art systems for the flow of hydraulic fluid to the motor to be controlled by an auxiliary spool valve through actuation of a handle on one of the control levers. The handle is normally biased to a neutral position. Pushing the handle in one direction strokes the auxiliary valve in a first direction, thereby causing hydraulic fluid to flow to the front mounted attachment in a first direction. Pushing the handle in the opposite direction strokes the auxiliary valve so as to supply fluid in a reverse direction.

Of the wide range of attachments used in conjunction with skid steer loaders the most common is a material handling bucket mounted to pivot relative to the lift arms. The bucket is operational over its full lift path, e.g., it is generally loaded while resting on or in the vicinity of the ground, it is then pivoted upwardly and lifted to an intermediate position for transport to a remote unloading area, and then it is unloaded by pivoting it downwardly to discharge its contents. When unloading takes place at an elevated bucket position relative to the loading position such as into the back of a dump truck, over the side of a manure spreader, etc., it is an advantage to have the bucket reach forward from its initial position, as it is being lifted. This is accomplished by the linkage system featured in the Halls patent mentioned above. This is a known advantage over systems wherein the lift arms have a fixed pivot causing the buckets to lift through an arcuate path. Because the pivot is above the bucket, the path initially moves toward the vehicle being loaded as it rises and then as it continues above the vertical height of the pivot, the path arcs back in the opposite direction, which requires the operator to simultaneously coordinate curl of the bucket with forward movement of the vehicle to place the bucket in its proper unload position.

Another common usage of skid steer loaders involves the necessity of maintaining the loaded material and thus the bucket in a stable condition as it is initially being lifted from the ground to a transport position. In prior art systems the bucket path is forwardly inclined initially, which again requires the operator to simultaneously coordinate controls, i.e., in this instance the bucket curl and lift controls are involved to avoid spillage or premature dumping of material being transported in the bucket. For example, see U.S. Pat. No. 4,162,873, issued Jul. 31, 1979 in the name of Raymond E. Smith, Jr., and U.S. Pat. No. 4,844,685, issued Jul. 4, 1989 in the name of Thomas M. Sagaser.

In all known prior art apparatus of which applicants are aware there is no system that provides for both an optimum initial vertical path as well as a maximum reach position below maximum height while still substantially maintaining such reach as the bucket continues to its maximum height position.

SUMMARY OF THE INVENTION

An important object of the present invention is to provide a skid steer loader having an improved method of moving a material handling attachment through a lift path that enhances operation while not reducing its overall effectiveness.

In pursuance of this and other important objects the present invention contemplates a skid steer loader comprising a main frame, ground support wheels extending from the main frame, a cab mounted on the main frame and having load bearing side walls extending upwardly from the main frame to define an operators control area therebetween, a boom structure comprising a pair of arms and a linkage assembly for operatively coupling the arms to the load bearing side walls, wherein each of the arms including a front portion having a front end extending beyond the cab, a rear portion extending behind the cab, and an integral intermediate portion between the front and rear portions. The loader further comprises material handling means supported on the front portions of the arms, a linkage assembly that includes an upper link associated with each of the arms, the upper link being pivotally secured to the cab at a location above the wheels, and a lower link associated with each of the arms, the lower link being pivotally secured to the cab at a location above the wheels, and power means operatively associated with the boom structure for raising and lowering in concert each of the pair of arms through a generally vertical path adjacent its corresponding load bearing side wall to which it is attached, for moving the front end of the boom arms and the material handling means along a lift path, in which loader a method of moving the material handling means in its lift path includes the steps of initially moving the material handling means from a known position in a substantially vertical direction to an intermediate position in the lift path, subsequently moving the material handling means from the intermediate position in a slightly forwardly inclined direction to a second intermediate position, and finally moving the material handling means from the second intermediate position in a substantially vertical direction to complete its lift path.

The foregoing and other objects, features and advantages of the invention will appear more fully hereinafter from a consideration of the detailed description which follows, in conjunction with the accompanying sheets of drawings wherein one principal embodiment of the present invention is illustrated by way of example. It is to be expressly understood, however, that the drawings are for illustrative purposes and are not to be construed as defining the limits of the invention.

DESCRIPTION OF THE PREFERRED EMBODIMENT

Figure 1:
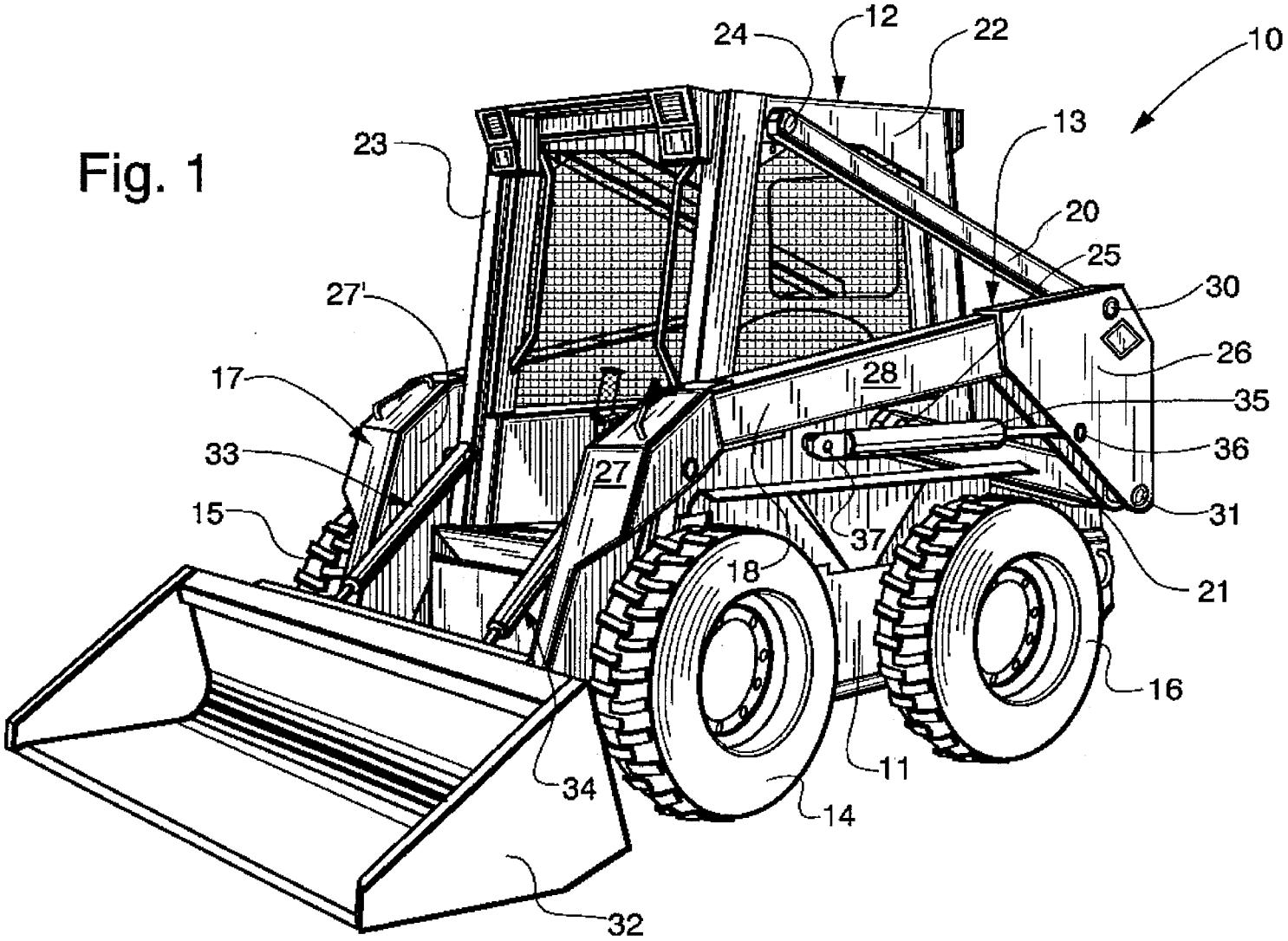
FIG. 1 is a perspective view of a skid steer loader in which the present invention is readily carried out.

Referring now to the drawings for a more detailed description of the present invention, FIG. 1 shows a skid steer loader 10 in which the method of the present invention is readily carried out. Loader 10, which utilizes a four bar linkage system of the type generally disclosed in U.S. Pat. No. 3,215,292, issued Nov. 2, 1965 in the name of L. M. Halls, hereby incorporated by reference, includes a main frame 11, a cab 12 and a boom assembly 13, all of which are supported by a pair of front wheels 14, 15 and a pair of rear wheels 16 (only one shown) mounted on axles (not shown) extending from main frame 11.

A pair of lift arms 17, 18 are swingably mounted via upper links 20 and lower links 21 to load supporting side walls 22, 23 of cab 12 via pivots 24 and 25, respectively. For convenience, because the elements on one side of skid steer loader 10 are paired with similar elements on the other side, only one side of the boom assembly mounting structure will be described in most instances in the following description. Each lift arm, comprising a rear portion 26, a forward portion 27 and an intermediate integral portion 28, accommodates upper link 20 and lower link 21 at pivots 30 and 31, respectively, in the rear portion 26 thereof.

Pivotally mounted to the forward portion 27 of lift arms 17, 18 is an attachment such as a material handling bucket 32 which is rotated with respect to the lift arms in a known manner by means of hydraulic tilt cylinders 33, 34. The entire boom assembly 13 and bucket 32 are raised and lowered by means of a pair of hydraulic cylinders 35, each of which is pivotally mounted to the rear portion 26 of lift arm 17 at a pivot 36 and side wall 22 at pivot 37.

Figure 2:
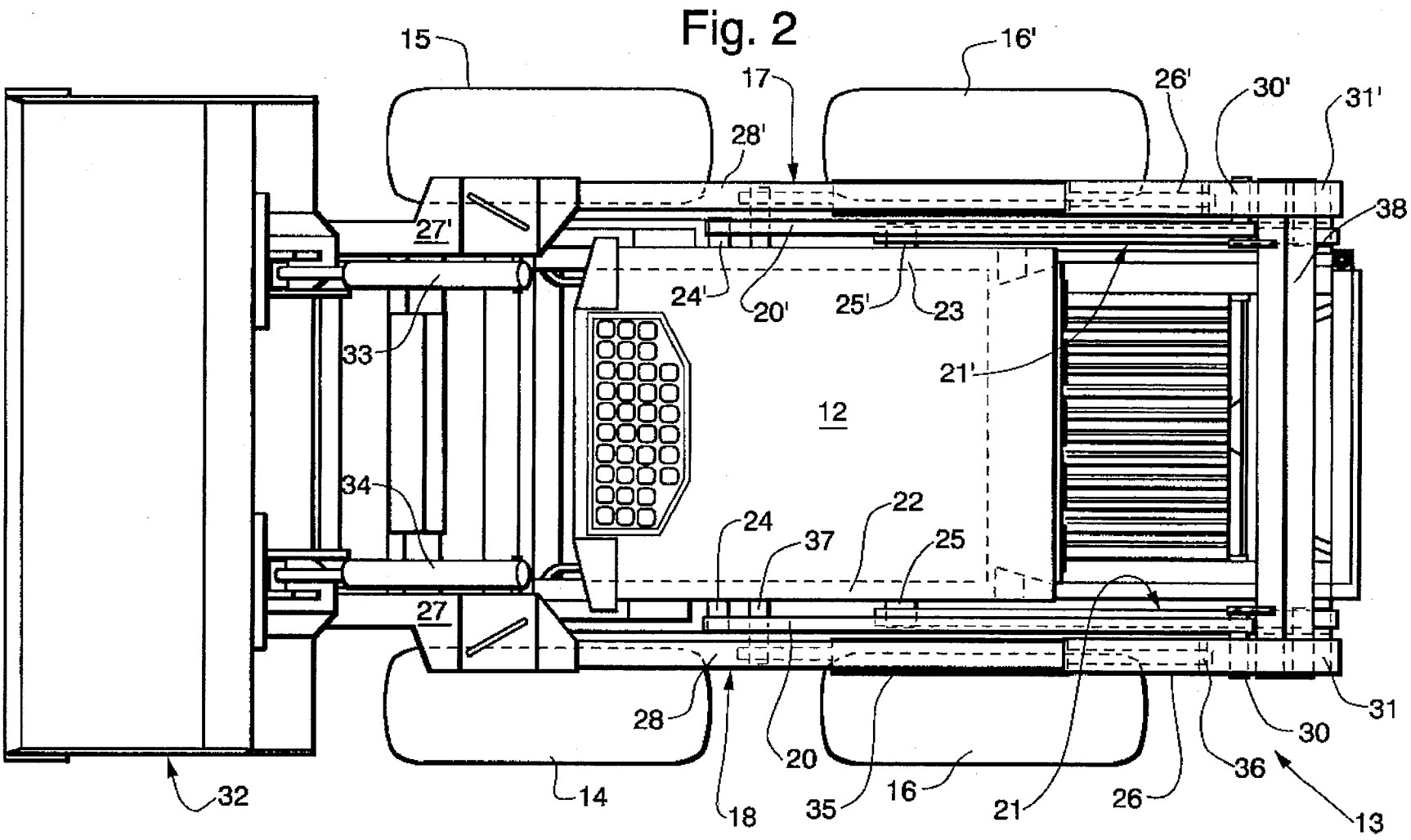
FIG. 2 is a top view of the loader shown in FIG. 1.
Figure 3:
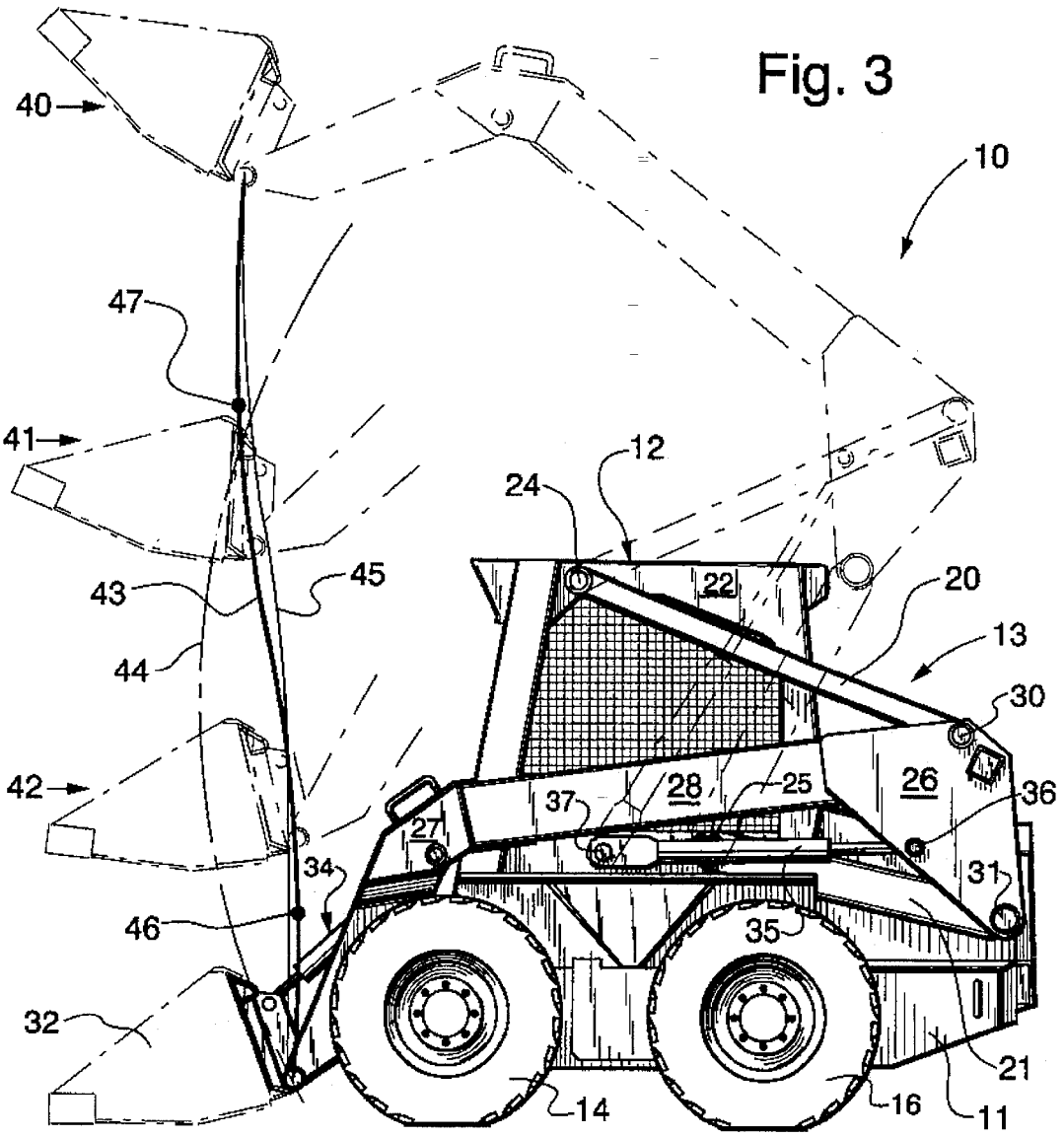
FIG. 3 is a side elevational view of the loader shown in FIG. 1 with the boom and bucket shown in solid lines in the home position and shown in phantom lines to depict various raised positions of the bucket.

Now turning to FIGS. 2 and 3, cab 12 is shown with load bearing side walls 22, 23 mounted on main frame 11 and extending upwardly from the outermost side wall thereof to define an operator control area in which various control levers, electrical switches, electronic display devices, etc. are located. The boom assembly 13, having lift arms 17, 18 attached to side walls 22, 23 by a linkage structure, is operative outwardly of the cab with the intermediate portions 28, 28' being disposed above wheels 14, 15, 16, 16' as depicted in FIG. 2. More specifically, intermediate portions 28, 28' are disposed above an imaginary plane through the uppermost point on each of the four wheels, which plane in generally parallel with the ground surface on which the loader is supported by such wheels.

The linkage structure, comprising upper links 20, 20' and lower links 21, 21', are pivotally attached to the cab side walls at 24, 24' and 25, 25' and to lift arms 17, 18 at 30, 30' and 31, 31' to support the entire boom assembly.

Under conditions where the hydraulic cylinders raise the boom assembly to lift bucket 32 from the position shown in solid lines in FIG. 3 to the elevated position shown in phantom in FIG. 3, the lift arms 17, 18 remain above the wheels during the process, which allows the cab to be positioned as shown, i.e., on the outermost location on the frame which accordingly permits the maximum utilization of space above the frame for operator control area between the side walls 22, 23. This is accomplished by the cantilevered pivot arrangement of the linkage structure at 24, 24', 25, 25', and the intermediate portions 28, 28' of arms 17, 18 above the topmost areas of surface of the wheels, i.e., above the imaginary plane mentioned above. The wheels can still be mounted to the side of frame 11 and extend outwardly for a minimum width based on the combined width of the frame and wheels and not be affected by the lift arm path of the boom assembly which is above the wheel in the area adjacent the side walls on which the boom assembly is supported.

Completing the boom assembly are forward portions 27, 27' of lift arms 18, 17 and rear portions 26, 26' of lift arms 18, 17. The forward portions extend beyond cab 12 and then slightly inwardly and downwardly to provide a convenient coupling for bucket 32 in front of the cab in the vicinity of the ground. The rear portions extend behind the back of the cab and are interconnected by transverse support element 38.

In operation of the skid steer loader in which the method of the present invention is readily carried out, the bucket 32 (or other material handling means), shown in the home position in the vicinity of the ground, is loaded in the usual manner. By activating the hydraulic lift cylinders the bucket is raised through a continuous series of intermediate positions until it reaches its maximum height position shown in phantom, and designated by reference numeral 40. During this lifting procedure the operator may, if necessary, operate tilt cylinders 33, 34 to curl the bucket relative to forward portions 27, 27' of lift arms 18, 17. During this lifting process the portions of the lift arms adjacent the sides of cab 12 start from a location above the wheels and move upwardly as the bucket is raised, which portion moves in a path that is parallel and adjacent the side walls 22, 23 of cab 12.

Two intermediate positions, designated by reference numerals 41 and 42, depict the position of bucket 32 as it is being raised along its path designated by reference numeral 43. Two other paths are illustrated in FIG. 3 to show the paths of prior art systems. Path 44 is generally arcuate and is exemplary of loaders having a boom with a fixed pivot point as mentioned above. Path 45, on the other hand, depicts a prior art system in which a linkage arrangement is used to couple the boom assembly to the frame and shows the path over which the present invention is an improvement. The unique path 43 of the bucket in the present invention initially is lifted in a generally vertical path until it reaches the approximate vicinity of intermediate point 46 after which it is lifted along a path that is generally inclined forwardly until it reaches the approximate vicinity of a second intermediate point 47. Subsequent to reaching point 47 bucket 32 travels along a generally vertical path until it reaches its maximum height 40.

Point 47 is the maximum forward reach of bucket 32 and it takes place prior to reaching its maximum height 40. In fact this maximum reach is attained at point 47 and is generally sustained until the bucket reaches its maximum height.

It is advantageous to lift the bucket vertically initially to maintain a stable condition until it reaches a transport position slightly elevated above the ground as for example at point 46 along its path of travel.

Of the many explicit and implicit advantages of the present invention, one of the most important is the provision of a boom assembly for a skid steer loader that is mounted via a linkage system to a load supporting cab in such a manner whereby the method of moving the material handling means, such as a bucket, is such that it travels along a generally s-shaped path. Initially, the path is generally vertical with various attendant advantages, not the least of which is the stability of the load. Subsequently the path reaches it maximum forward reach prior to reaching the maximum height and maintains such reach until the bucket attains maximum height. This enables the operator to unload the bucket over a wider range of heights then heretofore possible, without necessitating the need for manipulating multiple controls, i.e., the bucket curl in conjunction with the forward or reverse levers as well as the lift control.

While preferred structure is shown and described above in which the principles of the present invention are carried out, it is to be understood that the invention is not limited to such structure, but that, in fact, widely different means of varying scope and configuration may be employed in the practice of the invention.

Having thus described the invention, what is claimed is:

1. In a skid steer loader comprising a main frame, ground support wheels extending from said main frame, a cab mounted on said main frame, said cab including side walls extending upwardly from said main frame to define an operators control area therebetween, a boom structure comprising a pair of arms and a linkage assembly for operatively coupling said pair of arms to load bearing means on said main frame, each of said arms including a front portion having a front end extending beyond said cab, material handling means supported on said front portions, and power means operatively associated with said boom structure for raising and lowering in concert each of said pair of arms through a generally vertical path for moving said front end of said boom arms and said material handling means along a lift path, the method of moving said material handling means along its lift path including the steps of initially moving said material handling means from a known position in a substantially vertical direction to an intermediate position in said lift path that is rearward of said known position, subsequently moving said material handling means from said intermediate position along a slightly forwardly inclined direction to a second intermediate position that is forward of said known position, and finally moving said material handling means from said second intermediate position in a substantially vertical direction to complete its lift path at a final position that is rearward of said intermediate position, whereby the lift path of said material handling means from said known position to its final position is generally S-shaped in configuration.

2. In the method as set forth in claim 1 and further including the step of resting said material handling means forward of said main frame in close proximity to the ground under conditions where it is in said known position.

3. In the method as set forth in claim 1 wherein the step of subsequently moving, further comprises moving said material handling means to its maximum forward reach position under conditions where it attains said second intermediate position.

4. In the method as set forth in claim 3 and further including the step of resting said material handling means forward of said main frame in close proximity to the ground under conditions where it is in said known position.

5. In the method as set forth in claim 1 wherein the step of finally moving, further comprises moving said material handling means to its maximum height position under conditions where it has completed its lift path.

6. In the method as set forth in claim 5 and further including the step of resting said material handling means forward of said main frame in close proximity to the ground under conditions where it is in said known position.

7. In the method as set forth in claim 6 wherein the step of subsequently moving, further comprises moving said material handling means to its maximum forward reach position under conditions where it attains said second intermediate position.

* * * * *